US006145601A

United States Patent [19]

Mocivnik et al.

[11] Patent Number: 6,145,601

[45] Date of Patent: Nov. 14, 2000

[54] METHOD AND DEVICE FOR BORING HOLES

[75] Inventors: Josef Mocivnik, Fohnsdorf; Karl Bohm, Ansfelden, both of Austria

[73] Assignees: Techmo Entwicklungs-und Vertriebs GmbH, Fohnsdorf; "ALWAG" Tunnelausbau Gesellschaft m.b.H., Pasching, both of Austria

[21] Appl. No.: 09/466,072

[22] Filed: Dec. 17, 1999

Related U.S. Application Data

[63] Continuation of application No. PCT/AT98/00149, Jun. 17, 1998.

[30] Foreign Application Priority Data

Jun. 18, 1997 [AT] Austria ..... 1064/97

[51] Int. Cl.[7] ..... E01B 7/20

[52] U.S. Cl. ..... 175/69; 175/57

[58] Field of Search ..... 175/57, 65, 69, 175/205, 209, 211, 215, 218, 393; 405/259.5, 266, 269; 299/11, 33

[56] References Cited

U.S. PATENT DOCUMENTS

| | | | |
|---|---|---|---|
| 3,638,433 | 2/1972 | Sherard | 61/11 |
| 3,949,561 | 4/1976 | Chapman | 175/323 X |
| 4,253,781 | 3/1981 | Fischer et al. | 405/260 |
| 4,979,848 | 12/1990 | Sauer | 175/386 X |
| 5,129,470 | 7/1992 | Issakainen | 175/69 |

FOREIGN PATENT DOCUMENTS

| | | |
|---|---|---|
| 390303 | 9/1989 | Austria . |
| 1484572 | 3/1970 | Germany . |
| 4036721 | 6/1991 | Germany . |
| 19503122 | 8/1996 | Germany . |

*Primary Examiner*—Robert E. Pezzuto
*Attorney, Agent, or Firm*—Jacobson, Price, Holman & Stern, PLLC

[57] ABSTRACT

A process and device for boring holes in soil or rocks, in particular for percussion or rotary percussion boring. A bore hole is formed by an annular drill bit mounted on boring rods and at the same time a jacket tube which surrounds the boring rods with a certain gap is introduced. The annular drill bit is flushed during boring by a flushing medium fed into the annular gap defined between the boring rods and the jacket tube. When boring is completed, a setting suspension is fed into the annular gap to form an anchorage with the boring rods. An anchorage can thus be obtained in a simple and reliable manner immediately after a bore hole is completed, in particular in loose or slack material, by a device having a simple design.

10 Claims, 1 Drawing Sheet

METHOD AND DEVICE FOR BORING HOLES

The present application is a continuation application of PCT/AT98/00149, filed on Jun. 17, 1998.

BACKGROUND OF THE INVENTION

The present invention relates to method for drilling and, in particular, impact drilling or rotary percussion drilling holes in soil or rock material, wherein a drill hole is formed by means of a drill bit mounted on a drill rod assembly and being forced by the drill rod assembly and being non-positively coupled therewith and a jacket tube surrounding the drill rod assembly in a spaced-apart manner and being introduced by the drill bit preferably by tensile action is introduced simultaneously. Furthermore, the present invention relates to a device for drilling and, in particular, impact drilling or rotary percussion drilling holes in soil or rock material and forming an anchorage, wherein a drill bit mounted on a drill rod assembly and being forced by the drill rod assembly and being non-positively coupled therewith forms a drill hole and a jacket tube surrounding the drill rod assembly in a spaced-apart manner and following upon the drill bit and being introduced by the drill bit preferably by tensile action is provided.

For the production of drill holes and the subsequent provision of an anchorage, methods and devices are known in which a drill hole is made by drilling and, in particular, impact drilling or rotary percussion drilling by means of a drill bit mounted on a drill rod assembly and, usually after the at least partial removal of the drill bit from the drill hole and the insertion of a roof bolt and injection of a hardening suspension such as, for instance, a concrete mix in the jacket tube remaining in the drill hole roof bolts may be set and anchored in soil or rock material. The drill rod assembly usually is designed to be hollow as may be taken, for instance, from AT-B 390 303, in order to enable a flushing agent to be supplied into the region of the drill bit for flushing and cooling the same, the worked material usually being conveyed outwards on the external periphery of the drill rod assembly. A jacket tube following upon the drill bit is introduced into the drill hole simultaneously with the drilling procedure in order to prevent the surrounding material from breaking in and thus filling up the drill hole, in particular, in case of loose rocks, thereby creating a defined clearance zone for discharging the worked material optionally together with the flushing agent. After completion of the drill hole the jacket tube remains within the same, thus accordingly facilitating the setting of a roof bolt into the drill hole and the subsequent filling with concrete. It is, however, immediately apparent that the removal of the drill bit together with the drill rod assembly involves a lot of time. Furthermore, the introduction of the flushing agent and the removal of the flushing agent together with the material to be worked call for an accordingly large inner cross section between the drill rod assembly and the jacket tube in order to enable such a removal. Moreover, it is to be anticipated that, when using a jacket tube remaining in the drill hole, only parts of the drill bit can be extracted from the completed drill hole, to which end a complex and, most frequently, multipart drill bit structure must be provided in order to enable the partial removal of the same along with the drill rod assembly. Furthermore, the removal of the drill bit and the subsequent setting of a roof bolt as well as the subsequent filling with concrete may possibly involve difficulties, in particular with great drilling lengths, if the jacket tube is damaged or, for instance, bent or buckled during the drilling procedure and hence the full cross section of the drill hole may no longer be available for removing the drill bit and setting the roof bolt.

Moreover, there has for example become known from DE-A 40 36 721 a method and a device for introducing rods or tubes into soils or walls wherein via an outer driving rod the impact and drilling energy being necessary for forming a drill hole is introduced into a drill bit and wherein the drill bit is coupled with a bar in the interior of the impact tube. After finishing the drill hole the impact tube being freely supported on the drill bit is removed, whereafter by introducing a hardening suspension a fixation and anchoring of the bar being attached to the drill bit takes place in the grounding material after hardening of the suspension.

SUMMARY OF THE INVENTION

Departing from a method and a device of the initially defined kind, the present invention aims at providing a configuration which, in particular in at least partially slack or loose soil or rock materials, allows for simplified method control during drilling and subsequent anchoring and which, above all, requires little structural expenditure for the introduction of a flushing agent and subsequent anchoring.

To solve this object, the method according to the invention, departing from a method of the initially defined kind, is essentially characterized in that during the drilling procedure flushing of the drill bit is effected by introducing a flushing agent into the annular space defined between the drill rod assembly and the jacket tube and that, after completion of the bore, a hardening suspension is introduced into the annular space for forming an anchorage by the drill rod assembly. By the fact that, according to the invention, flushing of the drill bit is effected during the drilling procedure by introducing a flushing agent into the annular space defined between the drill rod assembly and the jacket tube, a simpler drill rod assembly configuration may be employed, since no precautionary measures are required for the introduction of the flushing agent into the interior of the drill rod assembly and subsequently into the drill bit, a sufficiently large passage area being provided in the annular space between the drill rod assembly and the jacket tube for introducing the flushing agent into the region of the drill bit. The method according to the invention particularly preferably may be applied, in particular, in slack or loose soil or rock materials, since in such loose materials the delivery to the soil surface both of the flushing agent and of the material to be worked in most cases is not necessary and the material to be worked as well as optionally the flushing agent can be displaced or compacted directly into the soil or rock material surrounding the drill hole. According to the invention it is, furthermore, provided that, after completion of the bore, a hardening suspension is introduced into the annnular space between the drill rod assembly and the jacket tube for forming an anchorage without previous removal of the drill bit and setting of a separate roof bolt such that the extremely time-consuming additional operating steps provided in the prior art, of at least partially removing the drill bit and the drill rod assembly from the drill hole and subsequently inserting a roof bolt may be obviated in the mode of procedure proposed by the invention, since the hardening suspension is introduced into the annular space between the drill rod assembly and the jacket tube immediately upon completion of the drill hole, the drill bit thus constituting an appropriate anchorage together with the drill rod assembly.

When applied in harder soils, in which an at least partial delivery of the worked material is sometimes required, it is preferably suggested that the drill hole is designed to have an internal diameter slightly larger than the external diameter of the jacket tube. In this manner, the flushing agent may be delivered to the soil surface, optionally along with worked material, on the external side of the jacket tube, it being additionally ensured that the jacket tube is introducible into the drill hole during the drilling procedure without excessive friction.

According to a further preferred embodiment, it is proceeded according to the invention in that the flushing agent is delivered into the soil or rock material surrounding the jacket tube via at least one passage opening provided in the drill bit and/or the jacket tube, whereupon, if required, the flushing agent is discharged from the drill hole along with the worked soil or rock material. This renders feasible the safe introduction of the flushing agent into the surrounding material and optionally the subsequent safe delivery of the hardening suspension into the surrounding and, in particular, loose soil or rock material at least in the region surrounding the drill bit, thereby enabling the discharging of material and, if desired, bonding with the surrounding material while establishing an efficient anchorage.

According to a further'preferred embodiment of the invention, it is proceeded in a manner that the hardening suspension is pressed into the annular space under pressure, thereby ensuring the accordingly complete filling of the annular space between the drill rod assembly constituting a roof bolt and the jacket tube and optionally also the accordingly simple emergence of the hardening suspension at least in the region of the drill bit or the consecutively arranged end of the jacket tube so as to provide for an appropriate anchorage while bonding with the surrounding material.

To solve the above-mentioned objects, a device for drilling of the initially defined type, in addition, is essentially characterized in that a flushing agent is introducible into the annular space defined between the drill rod assembly and the jacket tube during the drilling procedure for flushing the drill bit and that, after completion of the bore, a hardening suspension is introducible into the annular space for the formation of an anchorage by the drill rod assembly. As already indicated above, the safe introduction of a flushing agent into the region of the drill bit is, thus, feasible by means of a structurally simple embodiment, whereupon, after completion of the bore, the drill rod assembly as well as the drill bit remaining in the drill hole directly function as an anchoring means of the anchorage to be established, in an extremely timesaving manner as compared to the prior art by the subsequent introduction of the hardening suspension into the annular space defined between the drill rod assembly and the jacket tube.

In order to provide a clearance zone for the possibly required delivery of worked material together with the introduced flushing agent and enable the introduction of the jacket tube into the drill hole with as little friction as possible, it is, moreover, contemplated in a preferred manner that the drill bit is designed to have an external diameter slightly larger than the external diameter of the jacket tube.

According to a particularly preferred embodiment, it is suggested that the drill bit and/or the jacket tube in the region of the end following upon the drill bit comprises at least one passage opening for delivering the flushing agent into the surrounding soil or rock material, whereby, if desired, a safe anchorage of, and bonding with, the surrounding material may be obtained in the region of the drill bit by the delivery of the suspension in addition to the safe delivery of the flushing agent into the surrounding material after completion of the drill hole.

In order to obtain a firm and strong anchorage by means of the drill rod assembly constituting a roof bolt, it is, moreover, contemplated that the drill rod assembly has a solid material cross section and is designed to have a profiled outer surface and, in particular, thread- or rib-shaped elevations, as in correspondence with a further preferred embodiment of the device according to the invention. By designing the drill rod assembly with a solid material cross section, an accordingly stable anchor rod is subsequently formed, the rib-shaped elevations or thread-like outer shape of the drill rod assembly providing for an accordingly safe anchorage in the concrete anchor to be formed afterwards while introducing the hardening suspension.

If a direct connection is sought between the suspension to be introduced and the surrounding rock material, in particular in case of hard rock, it is contemplated according to another preferred embodiment that the jacket tube is detachably fixed to the drill bit or the drill rod assembly such that the jacket tube may be extracted from the drill hole as a function of the progressing introduction of the suspension.

In addition to the option of connecting the roof bolt to be produced after completion of the bore, with the surrounding material by providing at least one outlet opening in the end region of the jacket tube or removing the jacket tube, it is proposed according to another preferred embodiment that the jacket tube is made of a flexible material, which by introducing the hardening suspension under pressure has a cross section widened relative to the drill hole defined by the drill bit in a plane extending perpendicular to the longitudinal axis of the drill rod assembly at least partially over the longitudinal extension of the drill hole. By providing such a flexible configuration of the jacket tube, which is widened during the subsequent filling with the hardening suspension under pressure, the anchoring effect may be accordingly enhanced in regions of slack or loose subsoils by increasing the dimensions of the jacket tube, wherein, due to the presence of an undamaged, albeit partially widened jacket tube, the amount of the hardening suspension to be introduced may be accordingly limited without having to fear that previously not accurately determinable or definable quantities of the hardening suspension possibly will have to be introduced in case of the possible occurrence of cavities within the surrounding material in the region of the drill hole.

BRIEF DESCRIPTION OF THE DRAWINGS

In the following, the invention will be explained in more detail by way of an exemplary embodiment of a device according to the invention for carrying out the method of the invention, which is schematically illustrated in the annexed drawing. Therein.

DETAILED DESCRIPTION OF THE PREFERRED EMBODIMENT

Figure 1:
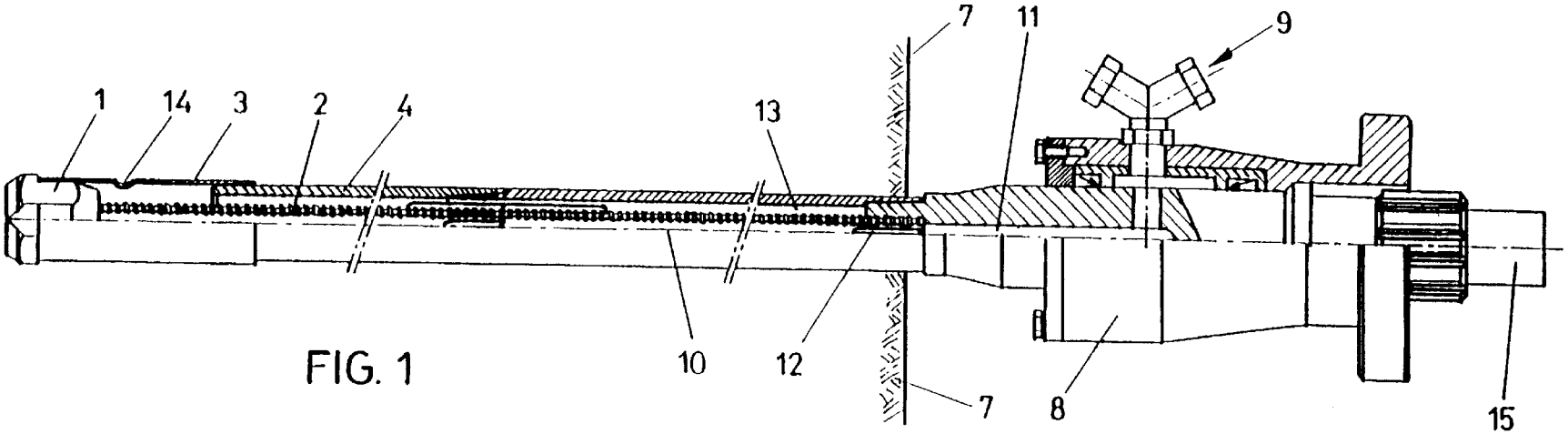
FIG. 1 is a partially sectioned side view of a drilling device according to the invention for carrying out the method of the invention.
Figure 2:
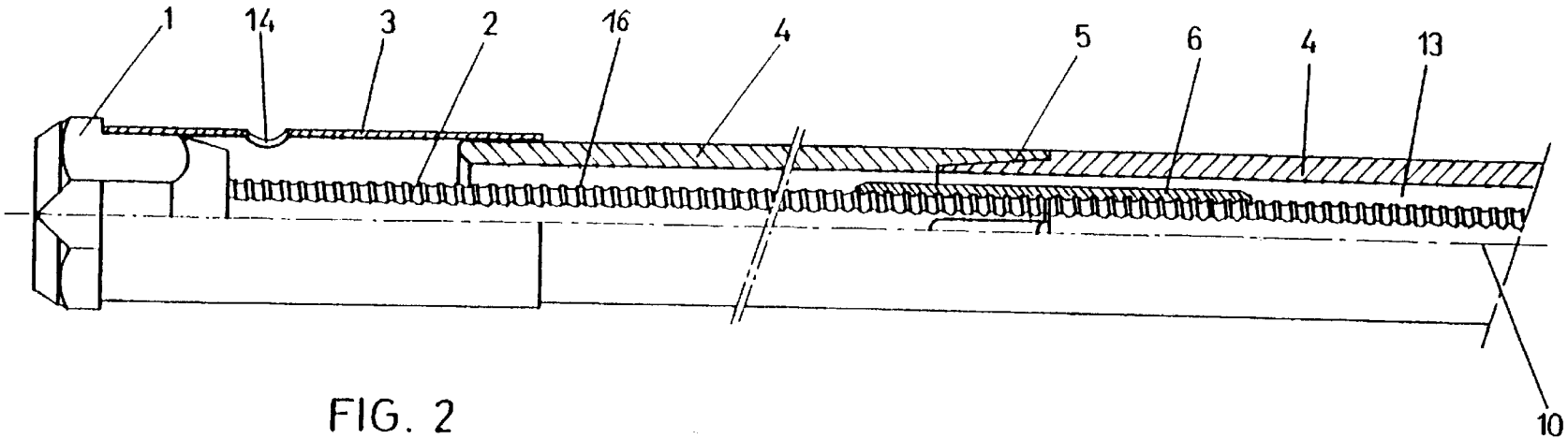
FIG. 2 in an enlarged illustration depicts a partial view of the front region of the drill bit and the consecutively arranged drill rod assembly as well as the jacket tube of the embodiment according to FIG. 1.

In the drawing, 1 each denotes a drill bit mounted on a drill rod assembly 2, which drill rod assembly 2 has a rib- or thread-like profiled contour 16 on its external periphery and a solid cross section. The rib-shaped or thread-like peripheral profile 16 is only partially indicated in FIGS. 1 and 2. During the drilling procedure, the drill bit 1 is imparted a rotating and/or percussive action via the drill rod assembly 2 in order to form a drill hole in the rock material not illustrated. Furthermore, a jacket tube follows upon the drill bit 1 at a distance from the drill rod assembly 2, wherein a first section of the jacket tube, which is denoted by 3, is directly connected with the drill bit 1 and, after this, the jacket tube 4 is comprised of individual sections depending on the drilling procedure, wherein a connection 5 which, for instance, is effected by means of screws is indicated between the individual sections of the jacket tube 4. Moreover, a connection realized, for instance, in the form of a sleeve 6, of the individual drill rod assembly sections is indicated in the region of the connection 5 of the individual jacket tube 4 sections.

As is apparent from FIG. 1, a flushing head generally denoted by 8 is provided outside the soil or rock in which the drill hole is to be produced, the soil surface being schematically indicated by 7, so as to follow the drill rod assembly 2 as well as the jacket tube 4, wherein a flushing agent such as, for instance, compressed air is introduced into a hollow space 11 extending in the direction of the axis 10, according to arrow 9. After this, the flushing agent, via at least one schematically indicated slot 12, is introduced from the hollow space 11 into the annular space 13 defined by the drill rod assembly 2 and the jacket tube or jacket tube sections 4. The flushing agent serves to flush and cool the drill bit 1, wherein at least one passage opening 14 is provided in the region of the first section 3 of the jacket tube for delivering the flushing agent and optionally the material worked by the drill bit 1 into the surrounding slack or loose material in the region of the drill bit 1 or immediately following thereupon. Actuation of the drill rod assembly 2 to cause the rotary and/or rotary percussive movement of the drill bit 1 is effected via actuating means known per se, which, for instance, engage at the projection 15 cantilevering from the flushing head 8.

Alternatively, water may, for instance, be used as a flushing agent in special applications, wherein, furthermore, due to the fact that the external diameter of the drill bit 1 is chosen to be slightly larger than the external diameter of the jacket tube sections 3, 4, worked material is discharged via the clearance zone provided on the external side of the jacket tube 3, 4 when using water as a flushing agent and, in particular, with hard rock. In any event, the larger external diameter of the drill bit 1 allows for the friction-poor or substantially friction-free introduction of the jacket tube 3, 4 during the drilling procedure.

After completion of the bore, the flushing head 8 is taken off and, after this, a hardening suspension such as, for instance, concrete is introduced under pressure into the annular space 13 defined by the drill rod assembly 2 and the jacket tube 3, 4 so as to provide for an appropriate anchorage with the drill rod assembly 2 serving as an anchor rod and the drill bit 1 remaining in the drill hole likewise serving the anchorage. Through the at least one passage opening 14 provided in the foremost section 3 of the jacket tube, the delivery or emergence of the hardening suspension into the surrounding material may be effected to ensure appropriate bonding of the thus produced anchorage with the surrounding material in case of loose material. The rib- or thread-like profile of the drill rod assembly 2, which serves as an anchor rod, in any event provides for accordingly good anchoring of the anchor rod in the setting concrete.

Moreover, the jacket tube or individual jacket tube sections 4 may be made of a flexible material so as to cause the widening of the jacket tube 4 at least over partial sections thereof and, accordingly, the enhancement of the anchoring effect of the anchorage to be produced, in a surrounding slack or loose material while introducing the hardening suspension under a high pressure.

Alternatively, it may be provided that the jacket tube 3, 4 is detachable from the drill bit 1 and that the jacket tube is pulled out of the drill hole as a function of the introduction of the suspension into the annular space between the drill rod assembly 2 and the jacket tube 3, 4, whereby a direct connection between the suspension surrounding the roof bolt formed by the drill rod assembly 2 and the surrounding rock material may be obtained. Such a detachability of the jacket tube section 3 may be obtained by simple locking or latching on the rear end of the drill bit 1, the fixation being detachable, for instance, by appropriate rotation between the jacket tube section 3 and the drill bit 1.

Thus, the time-consuming steps of at least partially removing the drill bit 1 and drill rod assembly 2 after completion of the bore and subsequently setting a roof bolt may be obviated by the drill rod assembly 2 and the drill bit 1 remaining in the drill hole after completion of the same and direct anchoring in the soil material being obtained by introducing the suspension into the annular space or clearance zone 13 provided between the roof-bolt-forming drill rod assembly 2 and the jacket tubes 3, 4.

What is claimed is:

1. A method for impact drilling or rotary percussion drilling holes in soil or rock material, said method comprising the steps of:

forming a drill hole by drill bit mounted on a drill rod assembly and by a force imparted by the drill rod assembly, introducing a jacket tube surrounding the drill rod assembly in a spaced-apart manner into the drill hole simultaneously with the drill bit by tensile action, and flushing of the drill bit by introducing a flushing agent into an annular space defined between the drill rod assembly and the jacket tube and after completion of the drill hole, introducing a hardening suspension into the annular space between the jacket tube and the drill rod assembly for permanently securing the drill rod assembly and the drill bit in the drill hole acting as an anchor bolt.

2. A method according to claim 1, wherein the drill hole has an internal diameter slightly larger than an external diameter of the jacket tube.

3. A method according to claim 1, wherein the flushing agent is delivered into the soil or rock material surrounding the jacket tube via at least one passage opening provided in the jacket tube, whereupon, the flushing agent is discharged from the drill hole along with worked soil or rock material.

4. A method according to claim 1, wherein the hardening suspension is pressed into the annular space under pressure.

5. A method according to claim 1, wherein the jacket tube is extracted from the drill hole while introducing the suspension into the annular space between the drill rod assembly and the jacket tube.

6. A device for impact drilling or rotary percussion drilling holes in soil or rock material and forming an anchorage, said device comprising:

a drill bit mounted on a drill rod assembly being forced by the drill rod assembly to form a drill hole, and a jacket tube surrounding the drill rod assembly in a spaced apart manner, the drill bit having an external diameter larger than an external diameter of the jacket tube wherein a flushing agent is introducible into an annular space defined between the drill rod assembly and the jacket tube during the drill procedure for flushing the drill bit and after completion of the drill hole, a hardening suspension is introducible into the annular space for the formation of a permanent anchorage of the drill bit and the drill rod assembly in the drill hole as an anchor bolt.

7. A device according to claim 6, wherein the jacket tube is made of a flexible material, which by introducing the hardening suspension under pressure has a cross section widened relative to the drill hole defined by the drill bit in a plane extending perpendicular to the longitudinal axis of the drill rod assembly at least partially over a longitudinal extension of the drill hole.

8. A device according to claim 6, wherein the jacket tube includes at least one passage opening for delivering the flushing agent into the surrounding soil or rock material.

9. device according to claim 6, wherein the drill rod assembly has a solid material cross section and has a profiled outer surface of thread- or rib-shaped elevations.

10. A device according to claim 6, wherein the jacket tube is detachably fixed with respect to the drill bit and the drill rod assembly.

* * * * *